US009920616B2

(12) United States Patent
Hay

(10) Patent No.: US 9,920,616 B2
(45) Date of Patent: Mar. 20, 2018

(54) METHOD AND APPARATUS FOR RANGING TO A NEARBY WELL FROM AHEAD OF A DRILL BIT

(71) Applicant: Halliburton Energy Services, Inc., Houston, TX (US)

(72) Inventor: Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 211 days.

(21) Appl. No.: 14/441,251

(22) PCT Filed: Nov. 14, 2013

(86) PCT No.: PCT/US2013/070117
§ 371 (c)(1),
(2) Date: May 7, 2015

(87) PCT Pub. No.: WO2015/073007
PCT Pub. Date: May 21, 2015

(65) Prior Publication Data

US 2015/0369036 A1 Dec. 24, 2015

(51) Int. Cl.
*E21B 47/01* (2012.01)
*E21B 47/022* (2012.01)
(Continued)

(52) U.S. Cl.
CPC ..... *E21B 47/01* (2013.01); *E21B 7/00* (2013.01); *E21B 10/00* (2013.01); *E21B 47/024* (2013.01); *E21B 47/02216* (2013.01)

(58) Field of Classification Search
CPC ..... E21B 47/01; E21B 47/024; E21B 10/00; E21B 7/00; E21B 47/02216
See application file for complete search history.

(56) References Cited

U.S. PATENT DOCUMENTS 5,295,548 A 3/1994 Yuasa et al.
6,269,891 B1 8/2001 Runia
(Continued)

FOREIGN PATENT DOCUMENTS

WO 2011/050061 A2 4/2011
WO 2012/067611 A1 5/2012

OTHER PUBLICATIONS

International Preliminary Report on Patentability issued in related Application No. PCT/US2013/070117, dated May 26, 2016 (11 pages).
(Continued)

*Primary Examiner* — Brad Harcourt
(74) *Attorney, Agent, or Firm* — Benjamin Fite; Baker Botts L.L.P.

(57) ABSTRACT

A method and apparatus for ranging from ahead of a drill bit is described. The ranging apparatus includes a ranging probe with at least one sensor that may be deployed ahead of the drill bit. The ranging probe may be conveyed via a cable through the interior of a drill string. In an alternative embodiment, the ranging probe may be attached to a ram that is seated inside of the drill string and that may be extended and retracted. In such an embodiment, the ranging probe may be retrievable by cable. The ranging probe optionally includes collapsible arms that retract when the ranging probe is inside the drill string or drill bit and that extend when the ranging probe is deployed ahead of the drill bit. One or more ranging sensors may be coupled to the collapsible arms. Ranging measurements may be communicated to the surface using telemetry.

15 Claims, 6 Drawing Sheets

Figure 1A:
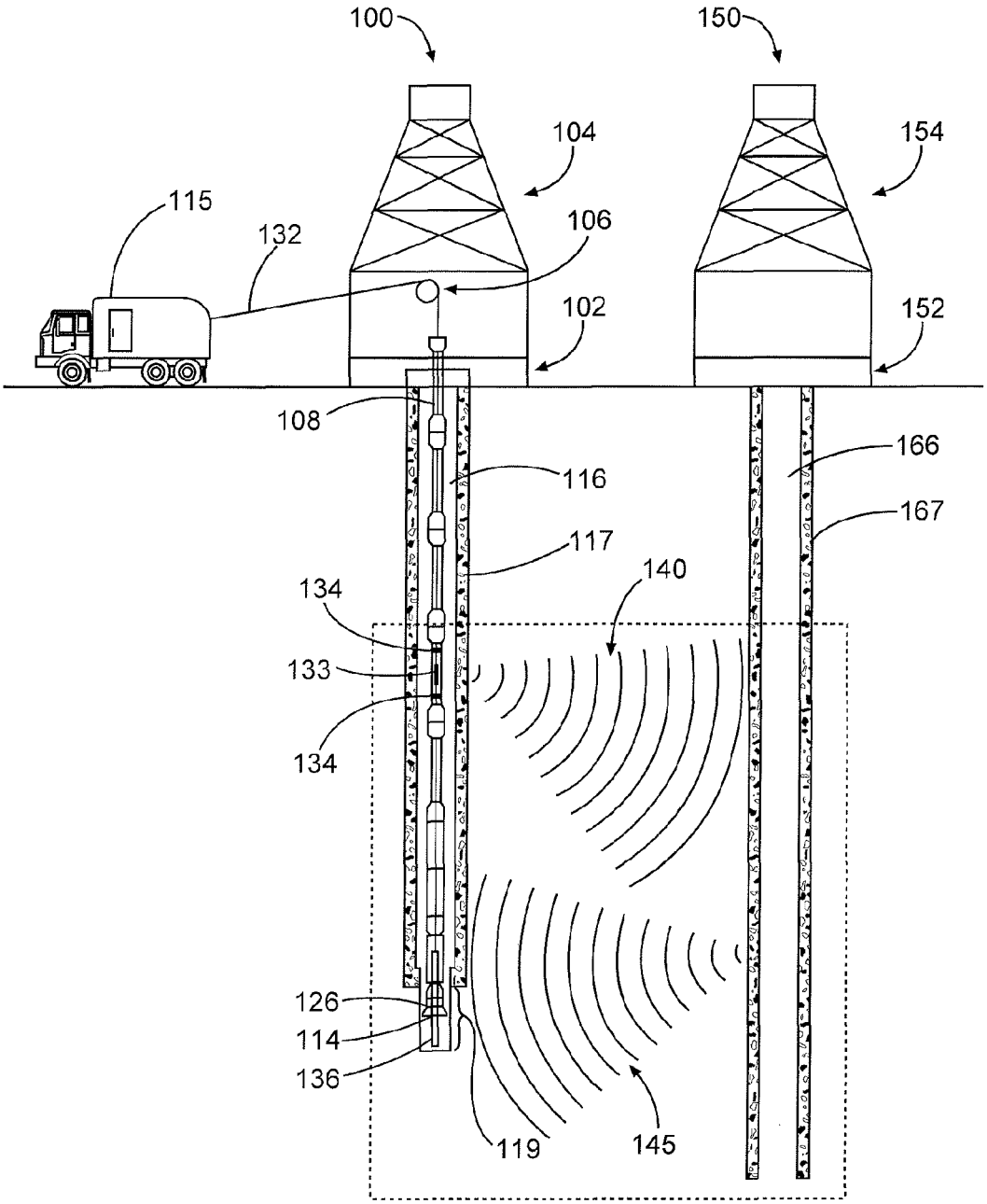

(51) Int. Cl.

| | |
|---|---|
| ***E21B 7/00*** | (2006.01) |
| ***E21B 10/00*** | (2006.01) |
| ***E21B 47/024*** | (2006.01) |

(56) References Cited

U.S. PATENT DOCUMENTS

| | | | | |
|---|---|---|---|---|
| 6,702,041 | B2 | 3/2004 | Runia | |
| 7,134,493 | B2 | 11/2006 | Runia | |
| 7,207,398 | B2 | 4/2007 | Runia et al. | |
| 7,287,609 | B2 | 10/2007 | Runia et al. | |
| 7,426,968 | B2 | 9/2008 | Hall et al. | |
| 7,681,642 | B2 | 3/2010 | Bell et al. | |
| 7,841,400 | B2 | 11/2010 | Wells et al. | |
| 8,016,053 | B2 | 9/2011 | Menezes et al. | |
| 2004/0118611 | A1 | 6/2004 | Runia et al. | |
| 2007/0114061 | A1 | 5/2007 | Hall et al. | |
| 2008/0156477 | A1* | 7/2008 | Aivalis | E21B 23/00 166/53 |
| 2010/0096187 | A1* | 4/2010 | Storm, Jr. | E21B 10/62 175/50 |
| 2010/0155139 | A1* | 6/2010 | Kuckes | E21B 47/02216 175/45 |
| 2011/0315445 | A1 | 12/2011 | Runia et al. | |
| 2012/0067644 | A1 | 3/2012 | Goswami et al. | |

OTHER PUBLICATIONS

Runia et al., "Through Bore Drilling Systems", SPE 79794, SPE/IADC Drilling Conference, Amsterdam, Feb. 19-21, 2003.

Runia et al. "Through Bit Logging: A New Method to Acquire Log Data, and A First Step on the Road to Through Bore Drilling", SPWLA 45th Annual Logging Symposium, Jun. 6-9, 2004.

International Search Report and Written Opinion issued in related PCT Application No. PCT/US2013/070117 dated Aug. 12, 2014, 17 pages.

Molchanov A.A. "Wireless measuring systems for surveying oil and gas wells" pp. 86-91, 2004.

Molchanov A.A. "Geophysical surveying of horizontal oil and gas wells" pp. 152-157, 2001.

Office Action issued in related RU Application No. 2016114163, dated Apr. 18, 2017 (8 pages).

* cited by examiner

METHOD AND APPARATUS FOR RANGING TO A NEARBY WELL FROM AHEAD OF A DRILL BIT

CROSS-REFERENCE TO RELATED APPLICATION

The present application is a U.S. National Stage Application of International Application No. PCT/US2013/070117 filed Nov. 14, 2013, which is incorporated herein by reference in its entirety for all purposes.

BACKGROUND

The present disclosure relates generally to well drilling operations and, more particularly, to a method and apparatus for ranging to a nearby well from ahead of the drill bit.

Well drilling and logging operations often require ranging measurements. Ranging measurements are taken at a reference point and detect electromagnetic, acoustic, nuclear or other emanations from a target. The ranging measurements may be used to identify, for example, the relative location or distance of the reference point from a known target, or to identify the location or distance of a target from a known reference. One common use of ranging is to allow a relief well to find a target blow-out well, follow the target blow-out well, and identify a suitable intersection point. Ranging measurements may be taken using a sensor located inside of a drill string, but they may be susceptible to interference from the drill string. For some ranging measurements, the drill string must be removed from the well prior to performing measurements in that well. Such tripping of the drill string before each ranging measurement, however, may be costly and time consuming.

FIGURES

Some specific exemplary embodiments of the disclosure may be understood by referring, in part, to the following description and the accompanying drawings.

FIGS. 1A-D illustrate an example ranging system.

Figure 2:
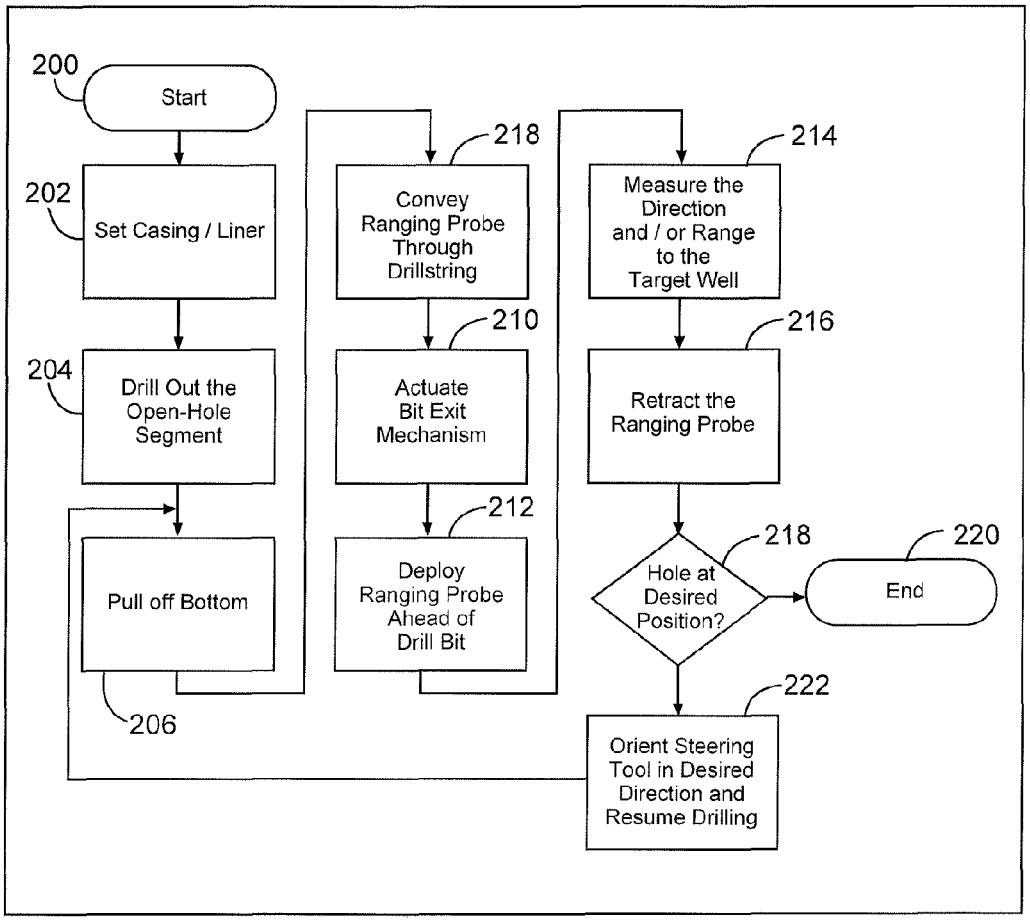

FIG. 2 is a flowchart showing the steps in an example ranging method.

Figure 3A:
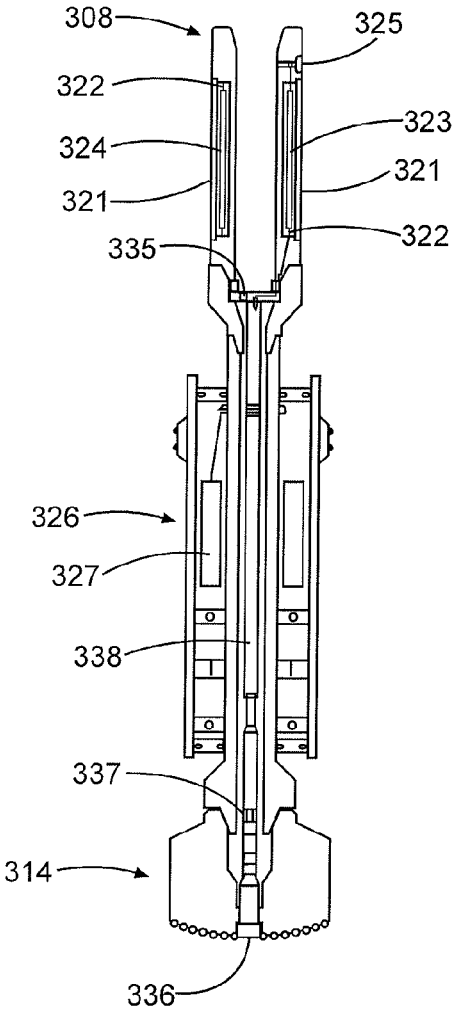
Figure 3B:
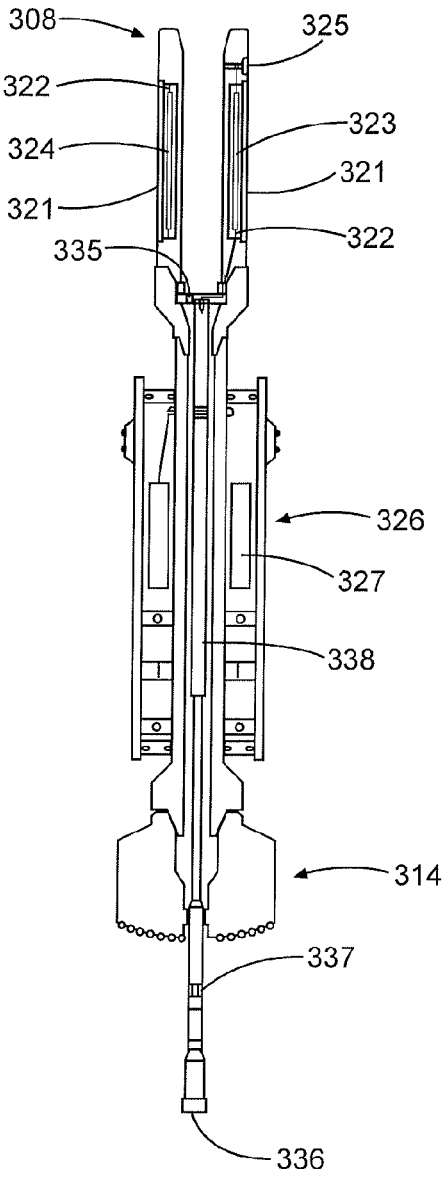

FIGS. 3A-B illustrate an alternative embodiment of a ranging system.

Figure 4A:
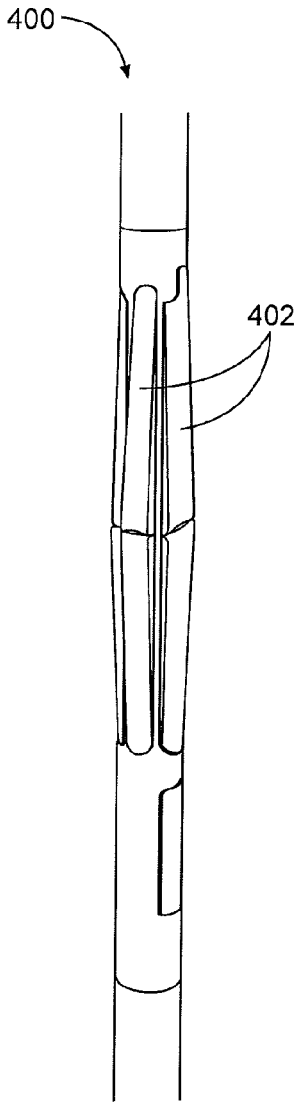
Figure 4B:
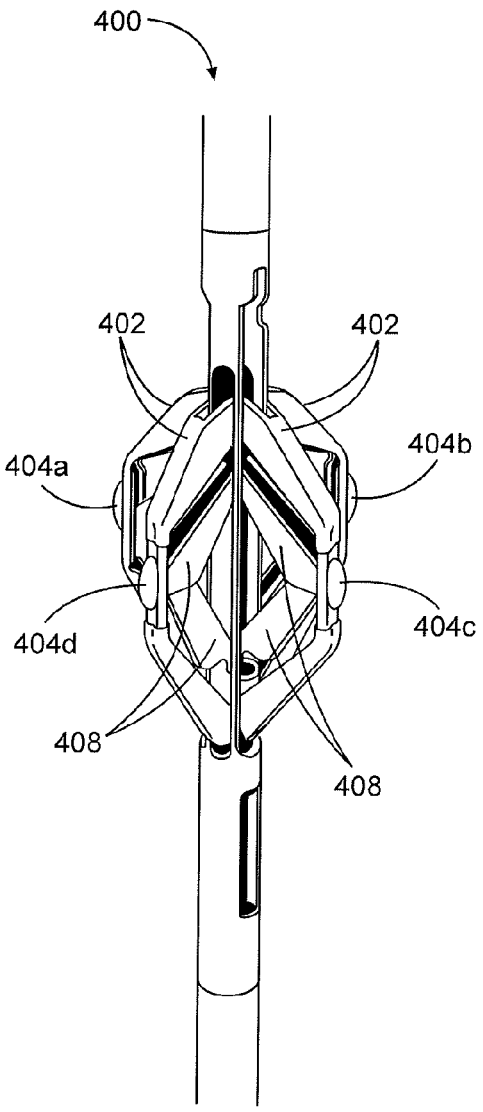

FIGS. 4A-B illustrate an example ranging probe.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to a method and apparatus for ranging to a nearby well from ahead of the drill bit Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Devices and methods in accordance with embodiments described herein may be used in one or more of MWD and LWD operations. Embodiments described below with respect to one implementation are not intended to be limiting.

FIGS. 1A-D show one embodiment of a system for ranging from ahead of the drill bit, specifically, ranging from a reference well 100 to a target well 150. The reference well 100 may include a drilling platform 102 that supports a derrick 104 having traveling block 106 for raising and lowering a drill string 108. A drill bit 114 is driven by a downhole motor and/or rotation of the drill string 108. As drill bit 114 rotates, it creates a borehole 116. A borehole casing or liner 117 may be set within borehole 116. The casing 117 provides several advantages, including preventing fluid leakage into or out of borehole 116 and enhancing structural integrity of the borehole 116. Open-hole segment 119 is the segment of borehole 116 below the set-point of casing 117.

Target well 150 is similar to reference well 100 and may include a drilling platform 152 that supports a derrick 154. In the exemplary embodiment of FIG. 1A, target well 150 is shown to include a borehole 166 and a borehole casing or liner 167 but is not shown to include a drill string. One of ordinary skill in the art would understand, however, that a drill string or other drilling or downhole equipment may be present without affecting operation of the disclosed system for ranging.

Although not shown in the embodiment of FIGS. 1A-D, one of skill in the art will appreciate that a well, such as reference well 150, may optionally include a pump that may circulate drilling fluid through a feed pipe, downhole through the interior passage of drill string 108, through orifices in drill bit 114, hack to the surface via the annulus around drill string 108, and into a retention pit. The drilling fluid may transport cuttings from the borehole 116 into the pit and aid in maintaining the borehole integrity. The flow of the drilling fluid may also aid in conveying a ranging probe 136 through drill string 108, drill collar 126, and into drill bit 114.

FIG. 1A shows the ranging probe 136 deployed ahead of a drill bit 114. With the drill string 108 raised off the bottom of the borehole 116, ranging probe 136 is inserted into the drill string 108 at the surface and conveyed through the interior of the drill string 108, drill collar 126, and drill bit 114. A wireline cable 132 is used to raise and lower the ranging probe 136. In alternative embodiments, other types of cable (such as wire rope cable) may be used.

The wireline cable 132 may have a plurality of conductors, including for communications, powering of the probe 136, and for excitation. In one or more embodiments the probe 136 is at least partially powered by internal sources in addition to or in lieu of being powered through the wireline cable 132, e.g. via a battery or other downhole power generation source. The probe 136 may store data internally for extraction after removal from the borehole 116, in addition to, or in lieu of, transmitting data to surface systems. The wireline cable 132 may be electrically coupled to a wireline truck 115, which may have a contact to ground as well as a generator. Once the ranging probe 108 reaches the drill bit 114, a tool port in the drill bit 114 opens as shown in FIG. 1D, enabling the ranging probe 136 to pass out of drill bit 114 and enter the open-hole segment 119. Once in the open-hole segment 119, the ranging probe 136 performs one or more ranging operations. The ranging operations may be performed at multiple locations within the open-hole segment 119 by, for example, raising and lowering the ranging probe 136.

FIG. 1A shows one embodiment of electromagnetic ranging. In that embodiment, wireline truck 115 may generate an excitation current on wireline cable 132. When casing 117 is electrically conductive and of relatively low resistance, wireline cable 132 can short circuit against it via an electrode 133. The electrode 133 can be an electrically exposed section of the excitation line in the wireline cable 132. The electrode 133 may be positioned above the ranging probe 136, generally a few hundred feet or more. Most of the generated excitation current flows up from the excitation point of the electrode 133 onto the casing 117 and to the grounding contact of wireline truck 115, which is generally connected to the well head or some other electrically compliant path 115. Some of the generated excitation current, however, flows through alternative conductive paths. One such conductive path is through the relatively high resistance earth from reference borehole 116 to target borehole 166 (shown in FIG. 1A as electric field 140), up the conductive and relatively low resistance target casing 167, and back to the grounding contact of wireline truck 115. The current flowing along casing 167 induces an electromagnetic field 145, which may be received by ranging probe 136. One or more electrically insulating gap subs may optionally be used in drill string 108. Insulating subs positioned in the drill string 108 below the excitation point may act to prevent current from flowing downward from the excitation point through the drill string 108. Such downward-flowing current may potentially interfere with measurement instruments further down in the drill string 108. Similarly, insulating subs positioned in the drill string 108 above the excitation point may act to prevent current from flowing upward from the excitation point through the drill string 108 and may thereby increase the amount of current flowing through the earth. FIG. 1A shows a dual sub configuration that includes two gap subs 134, one positioned above electrode 133 and the other positioned below electrode 133.

One of skill in the art will appreciate that alternative excitation points are possible. The excitation point may be on the wireline 132 above ranging probe 136, from across a gap sub, or any other point where emitted energy is reflected back to ranging probe 136. In embodiments where the ranging probe 136 is deployed below drill bit 114, the excitation point may be extended below drill bit 114 so that both the excitation point and ranging probe 136 are located below drill bit 114. In one or more embodiments, an excitation current may be generated directly on casing 167. In addition to excitation, wireline 132 may optionally also be used for downhole communications.

Figure 1B:
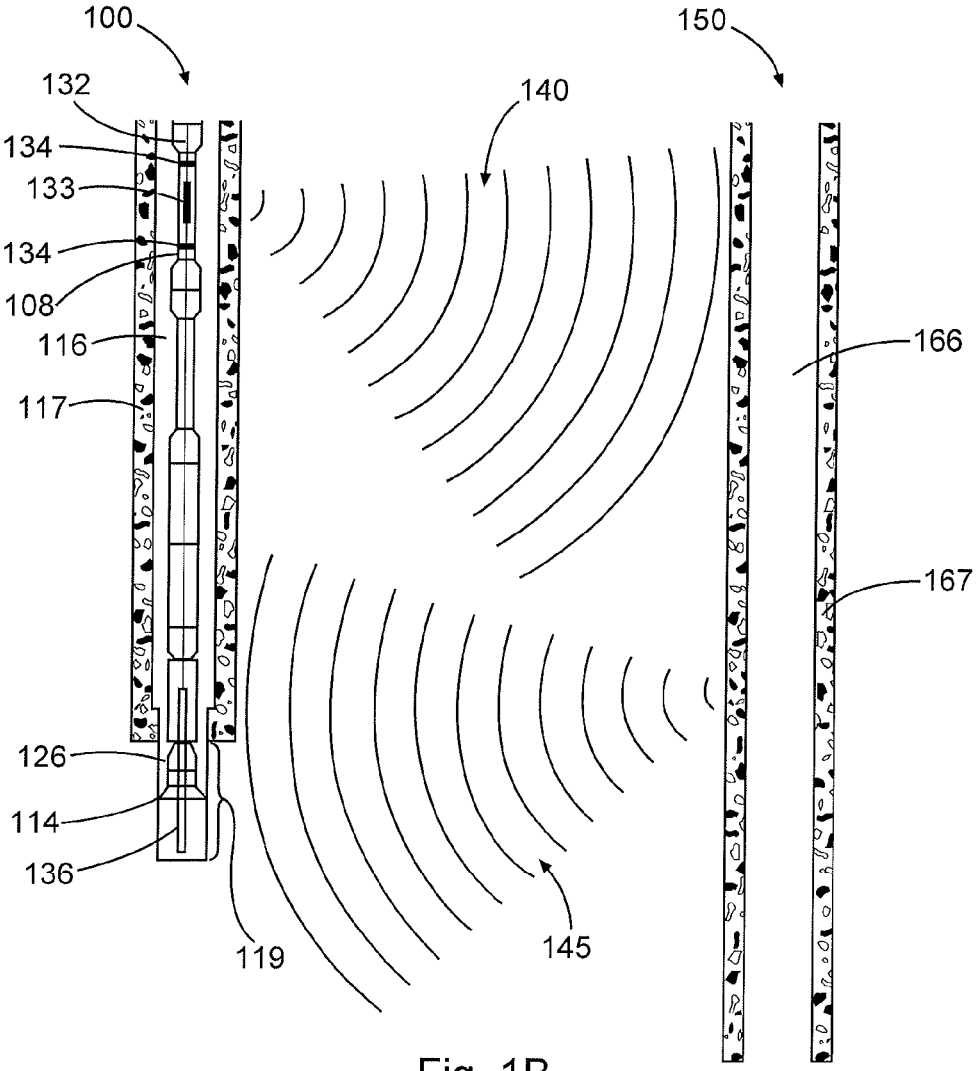

FIG. 1B shows a closer view of the system for ranging of FIG. 1A. In the embodiment shown, drill bit 114 and drill collar 126 are made of a ferrous material that may impede reception of the electromagnetic field 145 by ranging probe 136. Accordingly, in that embodiment, reception of electromagnetic field 145 is facilitated by raising drill string 108 off the bottom of borehole 116 so that probe 136 may be deployed ahead of the drill bit 114. In alternative embodiments, drill bit 114 and/or drill collar 126 may be composed of a non-ferrous material that does not impede reception of electromagnetic field 145 such that the probe 136 may be at least partially disposed within the drill bit 114.

Similarly, in the embodiment shown, reference casing 117 is made of a ferrous material and may impede reception of the electromagnetic field 145 by ranging probe 136. Accordingly, in that embodiment, reception of electromagnetic field 145 is facilitated by deploying ranging probe 136 into the open-hole segment 119 below the casing 117. In an alternative embodiment, the bottom portion of casing 117 may be composed of a non-ferrous material that does not impede reception of electromagnetic field 145. In such an alternative embodiment, the drilling out of open-hole segment 119 may not be necessary.

Figure 1C:
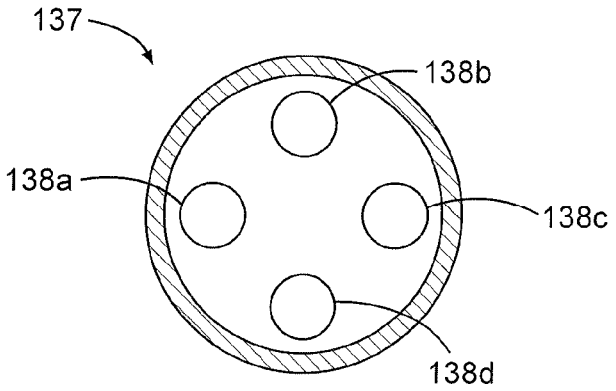
Figure 1D:
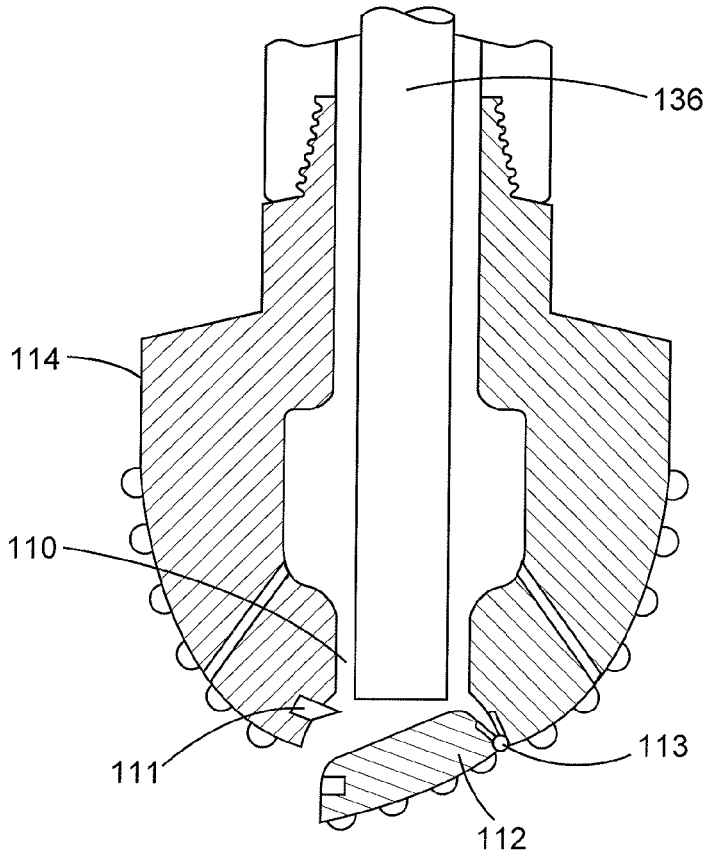

FIG. 1C shows a cross section 137 of ranging probe 136 illustrating one potential configuration of magnetometers used for reception of the electromagnetic field 145. The magnetometers may include, for example, one or more fluxgates. Such fluxgates may measure the intensity of electromagnetic field 145, and paired fluxgates may be used to measure the gradient of electromagnetic field 145. In the embodiment of FIG. 1C, four fluxgates 138*a-d* are shown; the opposite pair fluxgates 138*a* and 138*c* may be used as an X-axis gradiometer, and the opposite pair fluxgates 138*b* and 138*d* may be used as a Y-axis gradiometer. Optionally, Z-axis flux gates (not shown) may be used. Ranging probe 136 may also include a 3-axis accelerometer proximate to the flux gates in order to help resolve the horizontal direction to a target, such as target well 150, and the angle to the bottom of the reference hole, such as the bottom of reference well 100.

FIG. 1D shows a close-up of one embodiment of the interior of drill bit 114. In the embodiment of FIG. 1D, as ranging probe 136 enters a port 110 of drill bit 114, it causes a latching mechanism 111 to be disengaged. In some embodiments, latching mechanism 111 is disengaged by the action of ranging probe 136 on the bit as it passes through port 110 and approaches a plug 112. In other embodiments, latching mechanism 111 is disengaged when ranging probe 136 depresses a disconnect switch on plug 112. Release of latching mechanisms 111, enables plug 112 to swing on hinge 113 as ranging probe 136 proceeds through port 110 to be deployed ahead of drill bit 114.

In FIGS. 1A-D, reference well 100 is ranging to target well 150. In one embodiment, reference well 100 may be a relief well that is being drilled to intersect target well 150, which may be a blow-out well. The steps for ranging from the reference well 100 may include finding the target well 150, following the target well 150, and identifying a suitable intersection point in target well 150.

FIG. 2 is a flowchart showing the steps in an example ranging method, such as the embodiment shown in FIGS. 1A-D. At start 200, initial steering has been performed and a borehole has been drilled, such as borehole 116 from FIGS.

1A-D. In step 202, a casing is set in the borehole using methods known to those of skill in the art. After the casing has been set, an open-hole segment is drilled in step 204. In step 206, the drill string is pulled off the bottom of the borehole, and in step 208 the ranging probe is conveyed through the drill string. A bit exit mechanism is actuated in step 210 so that the ranging probe may deploy through the drill bit into the open-hole segment in step 212. The ranging probe takes ranging measurements in step 214, such as determining the direction and/or range to the target well. Once the measurements have been taken, at step 216 the ranging probe is retracted. The retraction of step 216 may include completely retracting the ranging probe from the drill string or only retracting the ranging probe into the drill bit or drill collar. The measurements received by the ranging probe may be communicated in real-time to a surface operator via known telemetry methods, such as mud-pulse telemetry or via a communicative conductive path in the wireline; alternatively, the measurements may be logged in the ranging probe, e.g. in memory disposed in the probe, and retrieved after the probe has been retracted. In step 218, the measurements are evaluated to determine whether the borehole is in the desired position. If the borehole is determined to be in the desired position, ranging operations may end at step 220. If the borehole is not determined to be in the desired position, a steering correction may be applied in step 222 and drilling resumed. When another ranging operation is desired, the method may be repeated beginning with pulling the drill off the bottom of the wellbore in step 206.

FIGS. 3A-B illustrate an alternative embodiment of a ranging system. In this embodiment, a drill string 308 may include a ranging probe 336 that may be connected to a ram 338. The ram 338 is shown to be seated inside drill string 308 using a hang-off ring 335. In FIG. 3A, the ram 338 is shown retracted such that ranging probe 336 is secured inside of a drill bit 314; in that configuration, drilling may proceed. In FIG. 3B, the ram is shown extended such that ranging probe 336 is deployed below drill bit 314; in that configuration, ranging probe 336 may take ranging measurements.

Ram 338 may extend and retract using methods known to those of skill in the art in light of this disclosure. For example, ram 338 may be a hydraulic ram or contain mechanical components to facilitate extension. The extension and retraction of the ranging probe 336 may be controlled by rotary steerable systems known to those of skill in the art. Such rotary steerable systems allow a surface operator to transmit commands to downhole tools and may be adapted to include commands for extending and retracting ram 338 and ranging probe 336.

In the embodiment of FIGS. 3A-B, drill string 308 is shown to be adapted for through-the-bit use. In the depicted embodiment, MWD/LWD sensors 324 and MWD telemetry controller 323 may be disposed in hatches 322 along the exterior of drill string 308 and protected by sealed hatch covers 321. As one of skill in the art will appreciate in light of the present disclosure, however, the use of a ram 388 and ranging probe 336 may be accomplished in a drill string that is not adapted for through-the-bit use.

Communication between a surface operator and ranging probe 336 may be achieved using known telemetry techniques such as mud pulse telemetry, EM telemetry, or acoustic telemetry for downlinking commands or instructions to the assembly and/or uplinking data from the downhole MWD/LWD, steering system, and ranging probe. For example, the MWD/LWD telemetry controller 323 may communicate with a surface operator using mud pulse telemetry pulser valve 325. Similarly, power may be provided to ram 338 and ranging probe 336 using known power supply techniques, such as a turbine powered electric generator, a hydraulic power generator, or battery power. In the embodiment of FIGS. 3A-B, for example, a power supply 327 is located proximate to steering tool 326.

A method for ranging using the ranging system embodiment of FIGS. 3A-B would be similar to the method shown in FIG. 2. Conveying the ranging probe through the drill string from the surface as in step 208, however, would not be required.

In another embodiment, the integrated ram 338 and ranging probe 336 may be adapted to be wireline retrievable. In such an embodiment, drill string 308 may be adapted for through-the-bit use, and ram 338 and ranging probe 336 may be seated in steering tool 326 using, for example, a releasable latch in the hang-off ring 335. Ranging probe 336 may therefore be extended and retracted by operation of ram 338, but if desired the surface operator may retrieve the ranging probe 336 and ram 338 by a wireline—without having to trip the drill string 308—by unlatching it from the hang-off ring 335 using an overshot or similar device on the end of a wireline deployed retrieval tool.

In the embodiments of FIGS. 3A-B, ranging probe 336 may have a single magnetometer 337 oriented away from the axis of the tool in a lateral direction. The magnetometer may be rotated by a motor and adjusted to find the peak signal strength direction to the source of the measured electromagnetic field (e.g., a target well), or the direction may be calculated from a series of rotational samples at different angular positions to resolve the direction to the source. The use of survey data and previous measurements may be used to resolve which direction the source is along the axis of the peak signal strength, as the signal may be coming from a direction of 180° different than the peak magnitude direction (since both solutions would resolve along the same axis). In alternative embodiments, use of both an X and a Y orthogonal cross axis magnetometers may provide enough information to resolve the direction without rotation.

Ranging techniques may include gradient measurements, in which case a magnetic gradiometer sensor might be used. In such embodiments, the rate of change of the magnetic field across the cross axis of the tool may be measured and the distance and direction may be determined, again with the use of surveys and prior measurements to determine on which side of the source the ranging probe is located, i.e., to resolve the 180° direction question. Gradient measurements may be achieved using a single sensor by taking multiple measurements at different points in space—for example, rotating the sensor during measurement. Multiple measurements may then be combined to calculate a gradient. In order to facilitate combining multiple measurements to calculate a gradient, ranging probe 336 may optionally include an accelerometer that correlates measurements with positions in space. In one or more embodiments, using two sets of gradiometers on the X and Y cross axis directions of the probe allows the distance and direction to be resolved without the need of rotation.

FIGS. 4A-B illustrate an alternative ranging probe embodiment. A ranging probe 400 is shown to contain collapsible arms 402. FIG. 4A shows the collapsible arms 402 in a retracted configuration. That configuration may be used while the ranging probe 400 is retracted inside of a drill bit or while the ranging probe 400 is being conveyed through a drill string. FIG. 4B shows the collapsible arms 402 in an extended configuration. That configuration may be used when the ranging probe has been deployed below the drill bit during a ranging operation. The collapsible arms 402 may be used as centralizers to position the ranging probe 400 coaxial with the borehole. Collapsing and expanding the collapsible arms 402 may be assisted by inner arms 408 and accomplished by spring-loading, hydraulics, or the like.

In the embodiment of FIG. 4B, four collapsible arms 402 are shown at 90 degree increments. Magnetometers 404*a-d* are disposed on the collapsible arms 402. The magnetometers may be operated during ranging operations to measure electromagnetic field intensity and gradient across the bore hole. For example, magnetometer pair 404*a* and 404*c* may be operated to measure an X-axis gradient, and magnetometer pair 404*b* and 404*d* may be operated to measure a Y-axis gradient. If the alignment and distance of magnetometers 404*a-d* is either known in advance or determined during the ranging operation, the gradient may be used to calculate the distance to the source of the measured electromagnetic field, such as, for example, a target well.

More or fewer collapsible arms and magnetometers may be used, and they may be placed in a variety of configurations. For example, additional collapsible arms and magnetometers may be placed at 45 degree increments, or magnetometers may be included within ranging probe 400. Moreover, magnetometers with different performance characteristics may be used. For example, the ranging probe 400 may include magnetometers with higher sensitivity that operate only in relatively narrower temperature ranges as well as magnetometers with lower sensitivity that operate in relatively broader temperature ranges. In this way, the ranging probe 400 may be robust to operate in a variety of downhole environments. Similarly, ranging probe 400 may include one or more accelerometers.

Although the embodiments shown have described ranging probes using magnetometers to measure magnetic gradients, other techniques for ranging are known to those of skill in the art and are within the scope of the present invention. For example, ranging may be accomplished using acoustic sensors. In such an alternative embodiment, sound waves emitted or reflected from a target well may be measured. In another alternative embodiment, ranging may be accomplished using radioactive sensors that measure radioactive emissions from a radioactive source in a target well.

Further, although the embodiments shown have described a vertical drilling orientation, where the ranging probe is deployed below the drill bit, non-vertical directional drilling or slant drilling wells are within the scope of the present disclosure. Regardless of drilling orientation, a person of ordinary skill will understand that a ranging probe may be disposed ahead of a drill bit, where "ahead" may be understood as meaning that the ranging probe is disposed further away from the opening of the borehole than the drill bit.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces. Additionally, the terms "couple", "coupled", or "coupling" include direct or indirect coupling through intermediary structures or devices.

What is claimed is:

1. A method for ranging, comprising:

introducing a drill string coupled to a drill bit into a borehole;

deploying at least one sensor ahead of said drill bit, wherein said at least one sensor is coupled to a ranging probe;

taking a ranging measurement to range from a reference well to a target well; and extending a collapsible arm coupled to said ranging probe, wherein said at least one sensor is disposed on said collapsible arm.

2. The method of claim 1, further comprising conveying the ranging probe through the interior of said drill string from a surface.

3. The method of claim 1, wherein said ranging probe is coupled to a ram.

4. The method of claim 3, wherein deploying said at least one sensor further comprises extending at least a portion of said ram ahead of said drill bit.

5. The method of claim 4, wherein said ram is a hydraulic ram.

6. The method of claim 3, further comprising retrieving said ranging probe with a cable disposed within the interior of said drill string.

7. The method of claim 1, further comprising generating an excitation current at an excitation point inside of said borehole.

8. The method of claim 7, wherein said drill string includes an insulating gap sub between said excitation point and said ranging probe.

9. The method of claim 7, wherein said drill string includes an insulating gap sub between said excitation point and an entrance to said borehole.

10. The method of claim 1, wherein deploying said at least one sensor further comprises opening a port in said drill bit.

11. A ranging system, comprising:

a drill string, wherein said drill string includes a drill bit;

a cable disposed within the interior of said drill string;

a ranging probe coupled to said cable, wherein the ranging probe determines one or more ranging measurements to range from a reference well to a target well;

at least one sensor coupled to said ranging probe, wherein said at least one sensor is disposed ahead of said drill bit; and a collapsible arm coupled to said ranging probe, wherein said at least one sensor is disposed on said collapsible arm, and wherein the collapsible arm is extendable.

12. The ranging system of claim 11, wherein said at least one sensor includes a magnetometer.

13. A ranging system, comprising:

a drill string, wherein said drill string includes a drill bit;

a ranging probe coupled to a ram, wherein said ram has a first position and a second position, wherein the ranging probe determines one or more ranging measurements to range from a reference well to a target well;

at least one sensor coupled to said ranging probe, wherein said at least one sensor is disposed within said drill string when said ram is in said first position and wherein said at least one sensor is disposed ahead of said drill bit when said ram is in said second position; and a collapsible arm coupled to said ranging probe, wherein said at least one sensor is disposed on said collapsible arm, and wherein said collapsible arm is extendable.

14. The ranging system of claim 13, wherein said ranging probe is retrievable by a cable disposed within the interior of said drill string.

15. The ranging system of claim 13, wherein said ram is a hydraulic ram.

* * * * *